United States Patent [19]

Corbett et al.

[11] Patent Number: 4,575,089

[45] Date of Patent: Mar. 11, 1986

[54] GOLF PRONATION DEVICE

[76] Inventors: William H. Corbett, Four Amalfi Pl.; Edward N. Snygg, 152 Peacock Dr., both of San Rafael, Calif. 94901

[21] Appl. No.: 592,350

[22] Filed: Mar. 22, 1984

[51] Int. Cl.[4] ..... A63B 69/36

[52] U.S. Cl. ..... 273/183 B; 273/189 A

[58] Field of Search ..... 273/189 A, 54 B, 183 B; 128/77; 272/67

[56] References Cited

U.S. PATENT DOCUMENTS

| | | | |
|---|---|---|---|
| 1,469,315 | 10/1923 | Hansard | 273/189 A |
| 3,099,448 | 7/1963 | Salvo et al. | 273/54 B |
| 4,017,086 | 4/1977 | Washburn | 273/189 R X |

*Primary Examiner*—George J. Marlo

*Attorney, Agent, or Firm*—Phillips, Moore, Lempio & Finley

[57] ABSTRACT

A golf pronation and training device comprises a first member adapted for attachment to an upper forearm of a golfer and a second member adapted for attachment to the hand of the golfer. A torsion spring is interconnected between the members for preloading the device with a predetermined magnitude of torquing force when the device is attached to the upper forearm and hand of the golfer. The device functions to rotate the golfer's lower forearm and hand to thereby "release" a golf club immediately following the moment of impact of a club head with a golf ball. In addition, the device induces a "square-to-square" relationship during a golfer's backswing.

8 Claims, 7 Drawing Figures

GOLF PRONATION DEVICE

TECHNICAL FIELD

This invention relates generally to a golf training device, and more particularly to a device that induces pronation of a golfer's leading forearm and hand to "release" a golf club immediately following the moment of impact of a club head with a golf ball.

BACKGROUND ART

Many training devices have been proposed for the purpose of improving a golfer's swing. However, the inventor's herein are unaware of any training device that encourages a golfer to "release" a golf club at the appropriate time during a golfer's swing and to also induce a "square-to-square" relationship during a golfer's backswing. William H. Corbett, a co-inventor herein, is a lifetime member of the Professional Golder's Association (PGA) and has for many years provided golf instruction for the novice amateur through the tour playing professional level.

During this period of such instruction, it has been found that one key factor in the development of a sound golf swing is the ability of a player to pronate his leading forearm and hand immediately following the point of impact of a club face of a golf club with a golf ball. The ability to pronate in this manner not only controls the accuracy of a shot, but also substantially increases the distance the ball will travel. In golf parlance, such pronation is termed "release" of the golf club. In addition, it is important that the golfer maintain a "square-to-square" relationship as between the club face and the target line during the take-away phase of his swing.

Current practice dictates that the golf instructor stand or kneel in front or alongside the player and hold his leading forearm and twist it in the direction of the target line at the appropriate moment during the golfer's swing to induce pronation. Obviously, it is difficult to impart the correct feeling of "release" to the golfer's forearm since the instructor can only estimate the proper torquing force required to be imposed on the forearm. Furthermore, the physical presence of the instructor next to the golfer prevents the golfer from completing his swing to realize the correct feeling of such release. Somewhat less difficulty is encountered in respect to teaching the golfer to maintain a "square-to-square" relationship on his take-away, i.e., maintaining the back of his left hand (for a right-handed golfer), wrist and lower forearm in a continuous, straight-line relationship that they should be in to most effectively produce a square-to-target club face alignment during impact.

DISCLOSURE OF INVENTION

The present invention is directed to overcoming the above, briefly-described problem by providing a golf pronation device that efficiently and repeatedly induces a golfer to release a golf club immediately following the moment of impact of a club head with a golf ball. The golf pronation device comprises first attachment means for releasably attaching the device to a leading forearm of the golfer, second attachment means for releasably attaching the device to a hand of the golfer that is connected to such forearm, and torsion means interconnected between the first and second attachment means.

The torsion means normally twists the second attachment means out of alignment relative to the first attachment means in a first rotative direction, and, when attached to the golfer's arm, imposes a torquing force on the hand and a lower forearm of the golfer. Such torquing force urges the hand and lower forearm in a second rotative direction, opposite to the first rotative direction, whereby the golf club will be released immediately following the moment of impact of the head of the golf club with the golf ball. In addition, such torquing force will induce the golfer to maintain a "square-to-square" relationship during the take-away phase of his backswing.

BRIEF DESCRIPTION OF THE DRAWINGS

Other objects and advantages of the present invention will become apparent from the following description and accompanying drawings, wherein.

BEST MODE OF CARRYING OUT THE INVENTION

Figure 1:
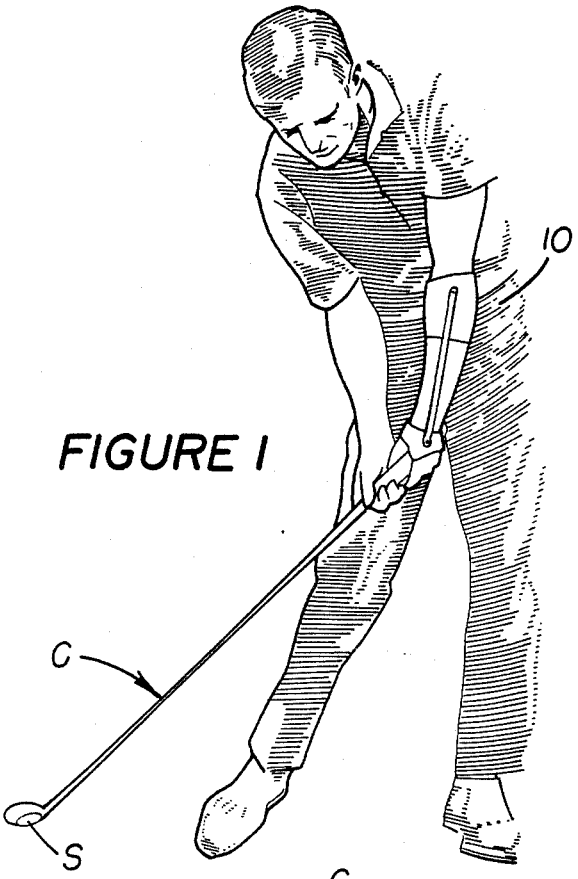
FIG. 1 illustrates a right-handed golfer having a pronation device embodiment of this invention attached on his forearm and hand during a practice swing.

FIG. 1 illustrates a right-handed golfer having a golf pronation device 10 of this invention attached to his forearm F and hand H. As will be appreciated by those skilled in the golf arts, the pronation device is attached to the leading arm of a golfer, i.e., the arm that leads in the downswing and is shown positioned closest to the intended target. As discussed more fully hereinafter, the pronation device functions to induce a golfer to release a golf club C immediately following the moment of "square" impact (FIG. 6) of a club head's striking face S with a golf ball G and further induces the golfer to maintain such "square" relationship during the take-away phase of his golf swing.

Figure 6:
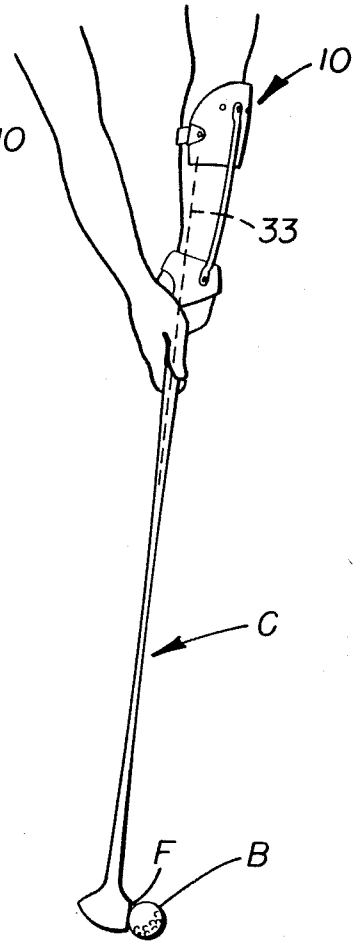

It is well known in the golf arts that the proper release of a golf club in this manner will substantially improve a golfer's ability to control the direction of a shot and will also increase the distance the struck golf ball travels. In the normal golf swing, the generally flat striking face S of the golf club will be substantially perpendicular relative to the target line at the point of impact ("square") with the golf ball (FIG. 6). A highly-skilled golfer, such as a touring professional, will normally release the club a split second subsequent to such impact, whereas intermediate and higher handicapped golfers will either not release the golf club at all or will release the golf club at a position substantially past the point of such impact.

In golfing parlance, the term "proper release" means the turning-over of the golfer's hands and leading forearm immediately following the moment of impact of striking face S of the golf club with ball B. This term is generally deemed synonymous with the term "pronation" which is generally defined herein as the act of rotating a forearm to turn-over the palm of the attached hand. As suggested above, this critical aspect of a golfer's swing is fundamental in providing a sound and repeatable golf swing.

Figure 2:
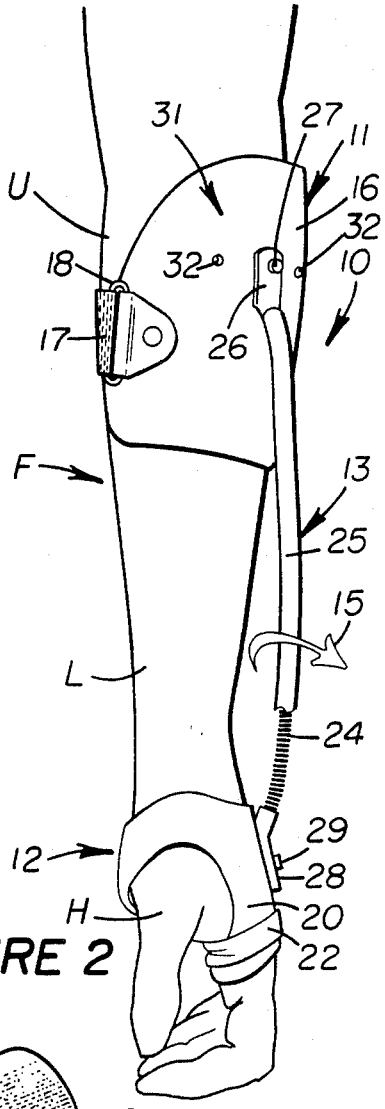
FIG. 2 is an enlarged view illustrating such attachment.
Figure 3:
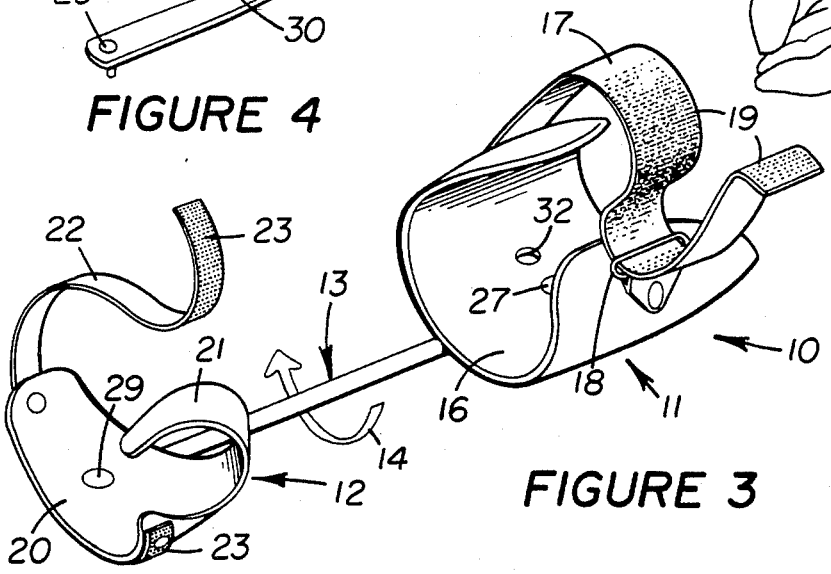
FIG. 3 illustrates the golf pronation device detached from the golfer's arm.

Referring to FIGS. 2 and 3, the illustrated golf pronation device comprises first attachment means 11 for releasably attaching the device to an upper forearm U of a golfer. A second attachment means 12 of the device is adapted to releasably attach the device to a hand H of the golfer that is connected to such forearm. A third element of the pronation device comprises torsion means 13 interconnecting the first and second attachment means.

In the unattached and "relaxed" condition of the pronation device illustrated in FIG. 3, the torsion means functions to twist the second attachment means relative to the first attachment means in a first rotatable direction 14 to place them in misalignment. When the device is attached to the arm of a golfer to place the first and second attachment means in general alignment (FIG. 2), a preloaded torquing or twisting force will be imposed on hand H and a lower forearm L of the golfer to urge them in a second rotative direction 15, opposite to direction 14. Thus, the golfer will be induced to maintain a "square-to-square" relationship during his backswing and to release the golf club at the proper moment in his swing, as described more fully hereinafter in reference to FIGS. 5 through 7.

As further shown in FIGS. 2 and 3, first attachment means 11 comprises a molded plastic member 16 defining a concavity therein, generally conforming to upper forearm U of a golfer. The member may be composed of a suitable plastic material that will exhibit sufficient rigidity and flexibility for this purpose. The first attachment means further comprises a flexible strap 17 secured on one side of the generally U-shaped member 16 and an eyelet or ring 18 secured on the other side thereof. The strap is adapted to be threaded through the ring in a conventional manner with the strap being folded onto itself and held in its tightened position by a Velcro-type fastener 19.

Second attachment means 12 comprises a second molded plastic member 20 defining a shallow concavity therein generally conforming to the back of hand H (FIG. 2) and an inwardly curved extension 21 defining an opening adapted to have a thumb of the hand inserted therethrough. The second attachment means further comprises a flexible strap 22, also adapted to be secured on the hand by a Velcro-type fastener 23 having a first portion secured on the strap and a second portion secured on member 20, as shown in FIG. 3.

Torsion means 13 may comprise any suitable type of torsion spring that is capable of being "wound up," when attached to the golfer's arm, under a predetermined amount of stored torquing force. By the process of trial and error, the proper amount of preloaded torquing force imposed on the hand and lower forearm of the golfer can be readily achieved. The magnitude of such stored torquing force will depend, of course, on the physical characteristics and abilities of the golfer under consideration.

In the embodiment illustrated, torsion means 13 comprises a closely coiled coil spring 24, suitably covered with a rubber or plastic protective coating 25. A first or upper end of the coil spring is suitably secured, such as by solder, to a metal bracket 26. The bracket is pivotally mounted on a releasable pin 27, pivotally mounting the bracket on member 16 of first attachment means 11.

Figure 4:
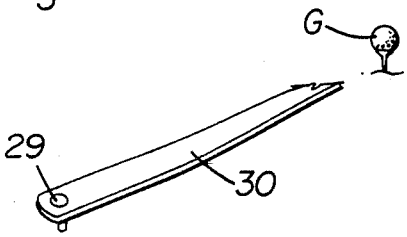
FIG. 4 partially illustrates an alternate torsion spring adapted to be used in the golf pronation device.

As further shown in FIG. 2, a second or lower end of spring 24 is likewise suitably secured to a bracket 28, pivotally mounted on member 20 of second attachment means 12 by a pin 29. It should be understood that other types of torsion springs can be utilized, such as a flat-bar type composed of a metallic or plastic material suitably composed and constructed to exhibit the desired physical characteristics required for imposing the desired amount of torquing force on the lower forearm and hand of a golfer. For example, FIG. 4 partially illustrates an optional flat and twisted plastic or metal spring 30 suitably sized and constructed to replace coil spring 24 and its torquing function.

FIGS. 2 and 3 further illustrate adjustment means 31 for adjustably connecting torsion means 13 on member 16 to selectively adjust the rotative misalignment of members 16 and 20 in FIG. 3 relative to each other (e.g., in the range of from 15° to 60°, depending on the torsional "strength" of spring 24). Thus, the torquing force preloaded into the torsion spring when the pronation device is attached to the arm of the golfer can be selectively varied to meet the demands of a wide variety of players with different physical characteristics and abilities. In the embodiment illustrated, adjustment means 31 comprises a plurality of openings 32 formed circumferentially on member 16 and pin 27 which comprises releasable fastening means for selectively attaching the upper end of torsion spring 24 in one of the openings. Alternatively, or in addition, such adjustment means could be utilized on member 20. Similar openings (not shown) could be formed in longitudinal alignment with openings 32 to adjust the separation distance between members 16 and 20, i.e., to vary such distance to accommodate different forearm lengths.

Figure 7:
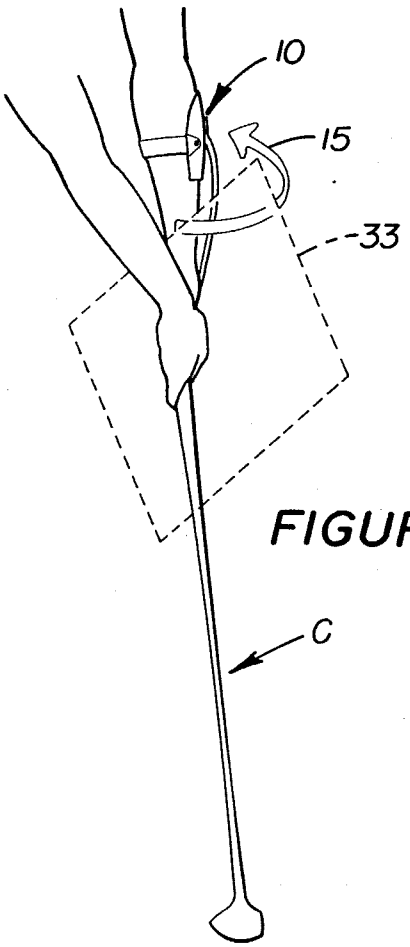
FIGS. 5 through 7 schematically illustrate a golf swing with the golf pronation device functioning to induce the golfer to release the golf club during a practice swing.
Figure 5:
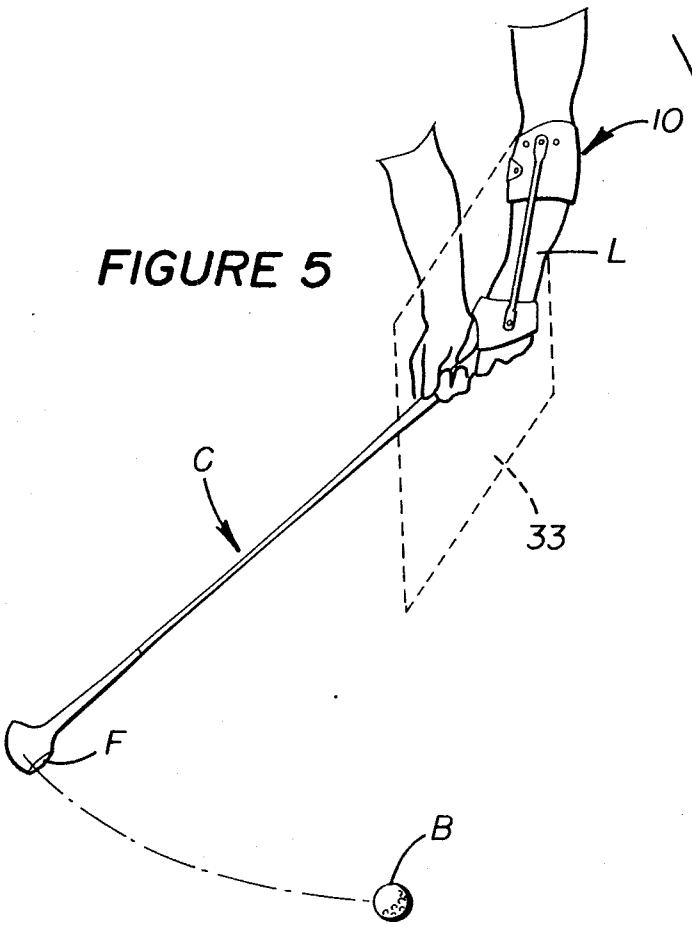

FIGS. 5 through 7 sequentially illustrate the release of golf club C during the golfer's swing and with an imaginary "plane" 33 generally cutting through the palms of his hands being illustrated during the swinging sequence. Pronation device 10 is first secured on the golfer's upper forearm F and hand H (FIG. 2) to impose the proper magnitude of stored-up torsional force therebetween. As discussed above, adjustment means 31 is adapted to selectively vary the magnitude of such force to meet the requirements of a particular golfer. In actual practice, it has been found that the desired amount of torquing force preloaded into torsion spring 24 generally approximates the amount of twisting force imposed on the golfer's arm by a "strong" hand of another person, such as a teaching pro.

Referring to FIG. 5, the torsion spring will resist against the golfer's tendency to have "flippy" wrists and to "fan-open" the club face during the take-away phase of his swing, i.e., to maintain a "square-to-square" relationship between the club face and the target line. Thereafter and when the head of club C approaches ball B during the golfer's downswing, he will "feel" a tendency for his lower forearm L (FIG. 2) to pronate. However, the golfer is advised by his instructor to resist such pronation at this point in his swing and to maintain the desirable "square-to-square" relationship between club face F and golf ball B.

At the moment of impact in FIG. 6, the palms of the golfer's hands and club face F are positioned at least substantially square to the target line. Immediately thereafter, torsion means 13 will function to impose a torquing force on the golfer's left hand and lower forearm to urge them in rotative direction 15, towards the target. The golfer then completes the arc of his swing with the right hand turning-over onto the left hand at the completion of his swing. As discussed above, the magnitude of torquing force preloaded into the torsion means can be selectively varied by use of adjustment means 31, shown in the form of adjustment openings 32 in FIGS. 2 and 3.

It should be understood that the above discussions and drawing illustrations relate to a golf pronation device adapted for use by a right-handed golfer. A mirror image of the device would be utilized by a left-handed golfer, with torsion means 13 thereof being preloaded in the opposite rotational direction when attached to the golfer's right arm. Thus, the above discussions relating to a golfer's swing relate to a right-handed as well as a left-handed golfer. For example, the "leading forearm" of a right-handed golfer would constitute his left forearm, whereas the "leading forearm" of a left-handed golfer would relate to his right forearm.

In certain applications it may prove desirable to use universal pivot joints in lieu of pivot pins 27 and/or 29. However, since torsion means 13 has a limited amount of "give" inherently built therein, the pivot pins have proven adequate in experimental practice sessions to afford the golfer limited universal freedom of arm movement.

We claim:

1. A sports training device for inducing a hand turn over upon swinging of an arm comprising;

first attachment means for releasably attaching said device to an upper forearm of a forearm, second attachment means for releasably attaching said device to a hand that is connected to said forearm, and torsion means interconnecting said first and second attachment means for normally twisting said second attachment means out of alignment relative to said first attachment means in a first rotative direction for imposing a torquing force on the hand and a lower forearm of said forearm when said first and second attachment means are attached in alignment to said upper forearm and said hand, respectively, to urge said hand and lower forearm in a second rotative direction opposite to said first rotative direction whereby said hand will be urged to turn over upon swinging of said arm when impacting a game ball with a sporting implement, and adjusting means for adjusting the connected orientation of said torsion means to at least one of said first and second attachment means for selectively varying the torguing force preloaded into said torsion means when said device is attached to said upper forearm and said hand.

2. The device of claim 1 wherein said first attachment means comprises a concave first member conforming to said upper forearm and means for releasably attaching said first member to said upper forearm.

3. The device of claim 2 wherein said means for releasably attaching said first member to said upper forearm comprises a flexible strap.

4. The device of claim 2 wherein said second attachment means comprises a second member generally conforming to the back of said hand and a curved extension formed on said second member defining an opening adapted to have a thumb of said hand inserted therethrough and means for releasably attaching said second member to said hand.

5. The device of claim 4 wherein said means for releasably attaching said second member to said hand comprises a flexible strap.

6. The device of claim 4 wherein said torsion means comprises a torsion spring pivotally connected to each of said first and second members.

7. The device of claim 6 wherein said adjustment means adjustably connects said torsion spring to said first member to selectively adjust the alignment of said first and second members and the torquing force preloaded into said torsion spring when said device is attached to said upper forearm and said hand.

8. The device of claim 1 wherein said torsion means comprises a torsion spring.

* * * * *